US010813180B2

(12) United States Patent
Qiao et al.

(10) Patent No.: US 10,813,180 B2
(45) Date of Patent: Oct. 20, 2020

(54) ILLUMINATION DEVICE HAVING MULTIPLE LIGHT SOURCES AND MANUFACTURING METHOD THEREOF

(71) Applicant: OPPLE LIGHTING CO., LTD., Shanghai (CN)

(72) Inventors: Shengyu Qiao, Shanghai (CN); Rukai Lian, Shanghai (CN); Jian Yu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/572,266

(22) Filed: Sep. 16, 2019

(65) Prior Publication Data

US 2020/0022230 A1 Jan. 16, 2020

Related U.S. Application Data

(63) Continuation of application No. PCT/CN2018/072606, filed on Jan. 15, 2018.

(30) Foreign Application Priority Data

Mar. 17, 2017 (CN) ..... 2017 1 0161947
Mar. 17, 2017 (CN) ..... 2017 2 0264111 U

(51) Int. Cl.

| | |
|---|---|
| ***H05B 33/08*** | (2020.01) |
| ***F21V 21/14*** | (2006.01) |
| ***F21V 14/02*** | (2006.01) |
| ***H05B 45/00*** | (2020.01) |

(52) U.S. Cl.

CPC ..... *H05B 45/00* (2020.01); *F21V 14/02* (2013.01); *F21V 21/14* (2013.01)

(58) Field of Classification Search

CPC ..... H05B 33/0803; F21V 14/02; F21V 21/14
See application file for complete search history.

(56) References Cited

U.S. PATENT DOCUMENTS

2014/0085896 A1 3/2014 Li

FOREIGN PATENT DOCUMENTS

| | | |
|---|---|---|
| CN | 201803209 U | 4/2011 |
| CN | 102691991 A | 9/2012 |
| CN | 103486506 A | 1/2014 |

(Continued)

OTHER PUBLICATIONS

International Search Report (including English translation) and Written Opinion issued in PCT/CN2018/072606, dated Apr. 20, 2018, 13 pages.

*Primary Examiner* — Joseph L Williams
(74) *Attorney, Agent, or Firm* — Arch & Lake LLP

(57) ABSTRACT

The present disclosure discloses an illumination device, which includes: a housing, a plurality of light source modules positioned in the housing, and a plurality of connection lines electrically connecting the plurality of light source modules. Each of the light source modules includes a base, a light source substrate provided on the base, a plurality of light sources provided on the light source substrate, electrical connection elements provided on the light source substrate, and a light distribution element connected with the base and/or the light source substrate. The light source substrate and the electrical connection elements are disposed between the light distribution element and the base, and the connection lines and the electrical connection elements are electrically connected.

21 Claims, 19 Drawing Sheets

(56) References Cited

FOREIGN PATENT DOCUMENTS

| | | | |
|---|---|---|---|
| CN | 105465669 | A | 4/2016 |
| CN | 205592804 | U | 9/2016 |
| CN | 106468838 | A | 3/2017 |
| CN | 106989362 | A | 7/2017 |
| CN | 206608910 | U | 11/2017 |

2
2131
214
2221
241
24
2
2
2

ILLUMINATION DEVICE HAVING MULTIPLE LIGHT SOURCES AND MANUFACTURING METHOD THEREOF

CROSS-REFERENCE TO RELATED APPLICATIONS

This application is based upon and claims the priority of PCT patent application No. PCT/CN2018/072606 filed on Jan. 15, 2018 which claims the priority of Chinese Patent Application No. 201710161947.4 filed on Mar. 17, 2017, and Chinese Patent Application No. 201720264111.2 filed on Mar. 17, 2017, the entire content of all of which is hereby incorporated by reference herein for all purposes.

TECHNICAL FIELD

The present disclosure relates to the technical field of illumination, and in particular relates to an illumination device.

BACKGROUND

An illumination device generally includes a housing, a light source panel fixedly mounted in the housing, a plurality of light-emitting diode (LED) light sources directly disposed on the light source panel, and a lampshade assembled to the housing. The plurality of LED light sources in the illumination device generally directly emit light in a starlight manner, that is, the plurality of LED light sources are directly soldered and arranged on the light source panel, and the LED light sources directly emit light after being driven by a driving power source.

SUMMARY

The present disclosure provides an illumination device and a method of manufacturing an illumination device.

The present disclosure provides an illumination device. The illumination device may include a housing, a plurality of light source modules positioned in the housing, and a plurality of connection lines electrically connecting the plurality of light source modules.

Each of the light source modules may include a base, a light source substrate provided on the base, a plurality of light sources provided on the light source substrate, electrical connection elements provided on the light source substrate, and a light distribution element connected with the base and/or the light source substrate.

The light source substrate and the electrical connection elements may be disposed between the light distribution element and the base; and the connection lines and the electrical connection elements may be electrically connected.

The present disclosure also provides a method of manufacturing an illumination device. The method may include providing a housing, positioning a plurality of light source modules in the housing, and connecting a plurality of connection lines electrically with the plurality of light source modules, and where each of the light source modules comprises: a base, a light source substrate provided on the base, a plurality of light sources provided on the light source substrate, electrical connection elements provided on the light source substrate, and a light distribution element connected with the base and/or the light source substrate, and where the light source substrate and the electrical connection elements are between the light distribution element and the base, and the connection lines and the electrical connection elements are electrically connected.

It is to be understood that both the foregoing general description and the following detailed description are exemplary and explanatory only and are not restrictive of the present disclosure.

BRIEF DESCRIPTION OF THE DRAWINGS

The drawings described herein are provided to provide a further understanding of the disclosure and form a part of the disclosure. The illustrative examples of the present disclosure and the description thereof are intended to explain the present disclosure and are not intended to limit the present disclosure. In the drawings.

DETAILED DESCRIPTION

The technical solutions of the present disclosure will be described in a clearly and fully understandable way in conjunction with examples of the present disclosure and the accompanying drawings. It is apparent that the described examples are only a part of the examples of the disclosure, and not all of the examples. Based on the examples of the present disclosure, all other examples obtained by those skilled in the art without any inventive work are within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Sometimes, in a case where a part of the light-emitting diode (LED) light sources of the illumination device is damaged, the light source panel provided with the LED light sources needs to be replaced as a whole, because the LED light sources in the illumination device are integrated as a whole. Therefore, the maintenance cost of the illumination device will be relatively high. The present disclosure addresses this issue.

Figure 1:
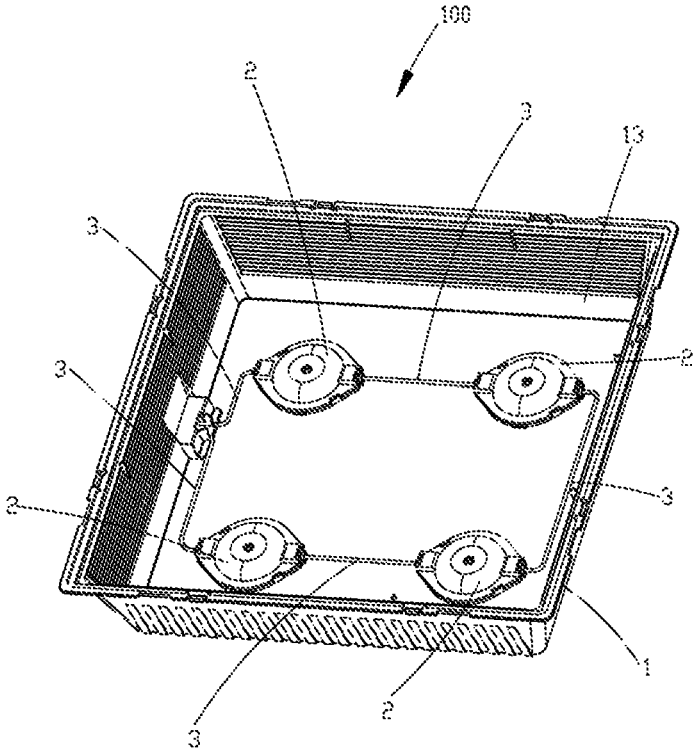
FIG. 1 is a perspective view of an illumination device according to a first example of the present disclosure.
Figure 2:
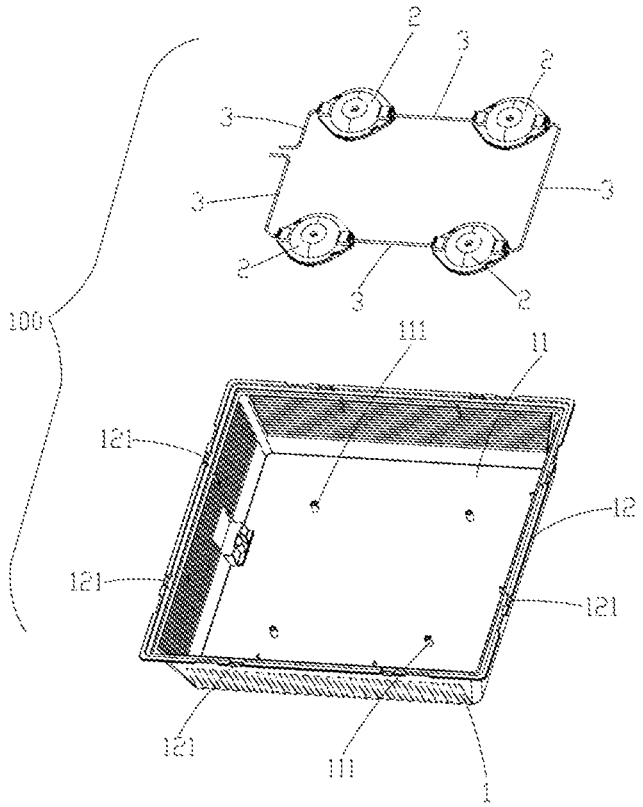
FIG. 2 is an exploded view of an illumination device according to a first example of the present disclosure.
Figure 3:
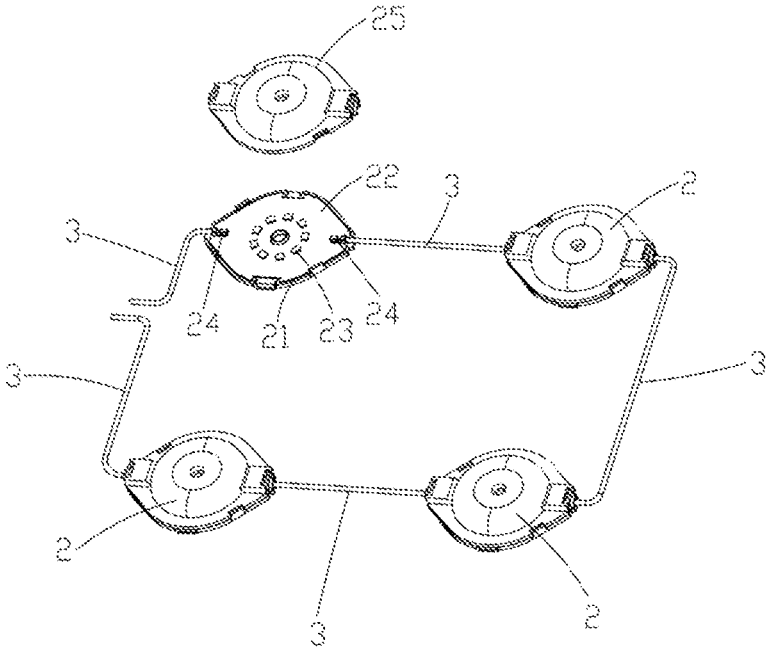
FIG. 3 is a perspective view of light source modules and connection lines in an illumination device according to a first example of the present disclosure.
Figure 4:
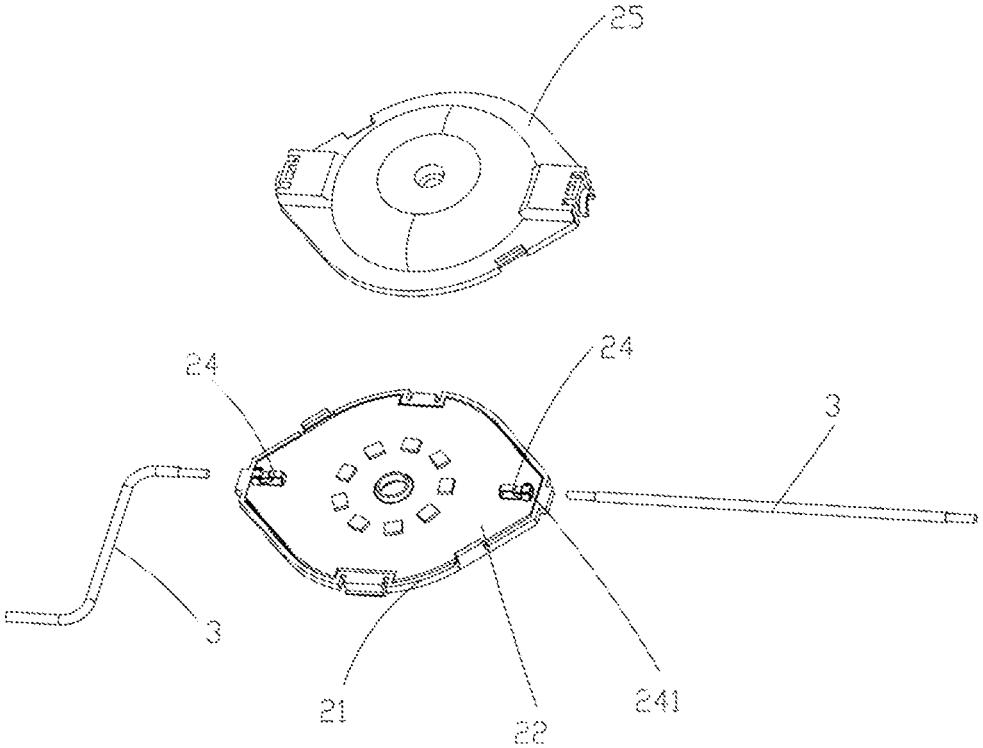
FIG. 4 is another perspective view of the light source modules and the connection lines of FIG. 3.
Figure 5:
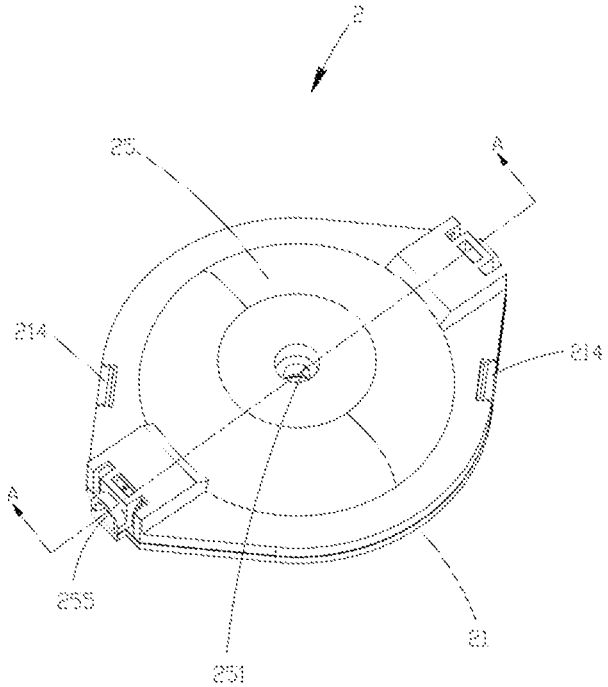
FIG. 5 is a perspective view of a light source module in an illumination device according to a first example of the present disclosure.
Figure 6:
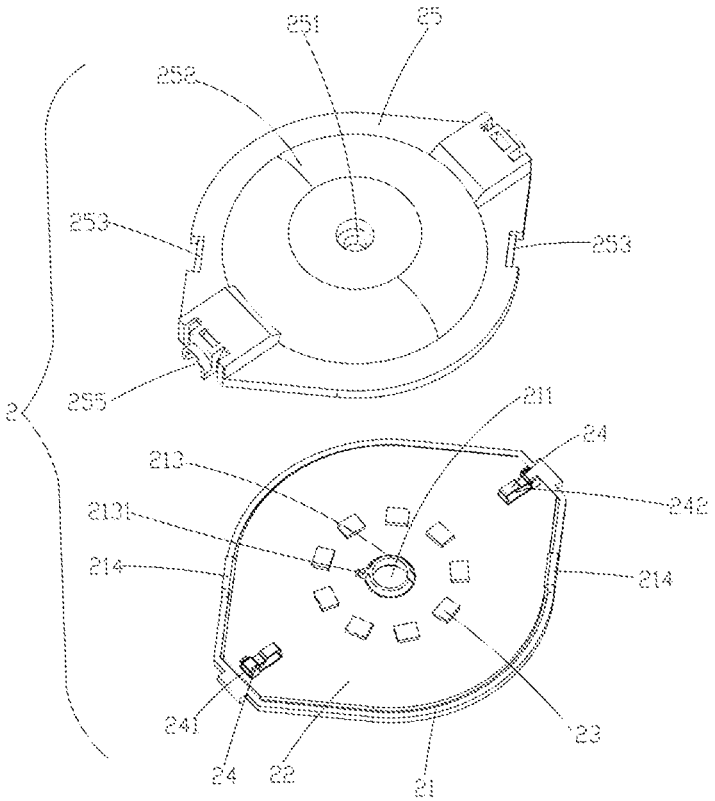
FIG. 6 is a partial exploded perspective view of FIG. 5.
Figure 7:
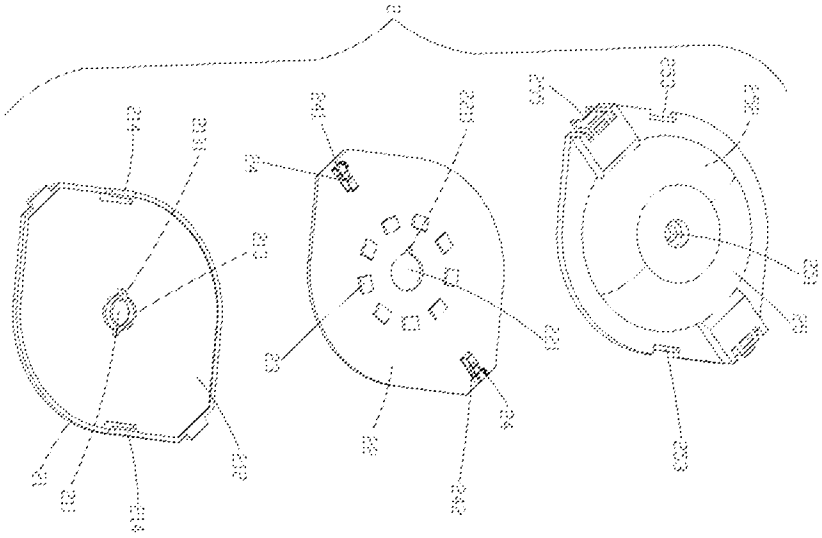
FIG. 7 is another exploded perspective view of FIG. 5.

For the first example, as shown in FIG. 1 to FIG. 2, an illumination device 100 provided by the first example of the present disclosure includes a housing 1, a plurality of light source modules 2 received and fixed in the housing 1, a plurality of connection lines 3 that electrically connect the plurality of light source modules 2, and a lampshade (not shown) that is assembled to the housing 1 and used to seal the light source modules 2 and the connection lines 3 in the housing 1. Further, the illumination device 100 further includes a driving power source (not shown) electrically connected to the plurality of light source modules 2, and the driving power source may be disposed inside the housing 1 or may also be disposed outside the housing 1. The illumination device 100 provided by the present example can be a kitchen-toilet lamp, a ceiling lamp, or a decorative lamp. The structures of respective elements in the illumination device 100 and the connection relationships therebetween are described in detail in the following description.

As shown in FIG. 1 and FIG. 2, the housing 1 may be made of an insulating material and includes a bottom wall 11 and a side wall 12 extending upward from an edge of the bottom wall 11. The housing 1 is provided with an accommodation space 13 for accommodating the light source modules 2 and the connection lines 3. Further, the bottom wall 11 of the housing 1 is provided with positioning posts 111 for pre-positioning the light source modules 2. A plurality of latching portions 121 that can be connected to the lampshade are provided on an edge of the side wall 12 of the housing 1. It should be noted that the positioning post 111 is hollow.

As shown in FIG. 1 and FIG. 2, the light source modules 2 are mounted on the bottom wall 11 of the housing 1. In the present example, a fixed connection between the light source modules 2 and the bottom wall 11 of the housing 1 can be achieved by screws (not shown). In other alternative examples, the fixed connection between the light source modules 2 and the bottom wall 11 can also be achieved by a snap-fit structure (not shown), or glue, or a magnetic element. The light source modules 2 in the present example have the characteristics of miniaturization and modularization and are easy to be replaced.

As shown in FIG. 3 to FIG. 9, the light source module 2 includes a base 21, a light source substrate 22 disposed on the base 21, and a plurality of light sources 23 disposed on the light source substrate 22, and electrical connection elements 24 disposed at two ends of the light source substrate 22, and a light distribution element 25 connected to the base 21. The light source substrate 22 is disposed between the light distribution element 25 and the base 21.

As shown in FIG. 3, FIG. 4, and FIG. 6 to FIG. 9, the base 21 is made of an insulating material and has a substantially elliptical shape, a first through hole 211 is disposed in a central region of the base 21, and the first through hole 211 penetrates an upper surface and a lower surface of the base 21. Further, the upper surface of the base 21 is provided with a recessed groove 212 for accommodating the light source substrate 22. The base 21 is also provided with a positioning convex rib 213 located inside the recessed groove 212. After the light source substrate 22 is accommodated in the recessed groove 212 of the base 21, the upper surface of the light source substrate 22 is substantially flush with the surface of the base 21.

In other alternative examples, the recessed groove 212 may not be provided within the base 21 described above. The positioning convex rib 213 is substantially annular and disposed around the first through hole 211, and the positioning convex rib 213 is used for pre-positioning the light source substrate 22. Further, the positioning convex rib 213 is further provided with a limiting portion 2131. In addition, snap-fit portions 214 for cooperating with the light distribution element 25 are provided on the edge of the base 21. In other alternative implementations, the fixed connection between the base 21 and the light distribution element 25 can also be achieved by screws (not shown).

As shown in FIG. 3, FIG. 4, and FIG. 6 to FIG. 9, the light source substrate 22 may be a printed circuit board, and the printed circuit board has conductive lines. A configuration of the light source substrate 22 on a horizontal plane may be substantially the same as the base 21 and light distribution element 25. The light source substrate 22 is substantially elliptical. The light source substrate 22 is provided with a positioning hole 221 corresponding to the first through hole 211 of the base 21. The positioning convex rib 213 on the base 21 and an inner sidewall of the positioning hole 221 on the light source substrate 22 are interference-fitted with each other, so that the light source substrate 22 and the base 21 are positioned with respect to each other. Further, the positioning hole 221 is further provided with an extending groove 2211 that extends radially, and the extending groove 2211 may cooperate with the limiting portion 2131 on the positioning convex rib 213. It should be noted that the cooperation of the extending groove 2211 and the limiting portion 2131 can prevent the light source substrate 22 from rotating relative to the base 21, and the limiting portion 2131 can also play a role of fool-proof.

As shown in FIG. 3, FIG. 4, FIG. 6, FIG. 7, and FIG. 9, the light source 23 can be an LED light source, i.e., an LED light-emitting unit, and can be mounted on the upper surface of the light source substrate 22 through surface mount technology (SMT) or Through Hole Technology (THT). The plurality of light sources 23 are electrically connected to each other through the conductive lines on the light source substrate 22. The plurality of light sources 23 are evenly distributed on the periphery of the positioning hole 221 in the circumferential direction, and the specific position and the specific amount of the light sources 23 can be adjusted according to actual lighting requirements. In the present example, the plurality of light sources 23 on the light source substrate 22 can be monochromatic-temperature light sources. Specifically, the monochromatic-temperature light sources refer to the plurality of light sources 23 on the light source substrate 22 having the same color-temperature value, and the monochromatic-temperature light sources 23 have one illumination effect after being lit.

As shown in FIG. 3, FIG. 4, FIG. 6, FIG. 7, and FIG. 9, in the present example, the electrical connection elements 24 are conductive terminals, and are electrically connected to both ends of the light source substrate 22 by a soldering method. The electrical connection element 24 has a receiving channel 241 and two contact arms 242 extending into the receiving channel 241. One end of a connection line 3 is directly inserted into the receiving channel 241 so that a wire (not shown) in the connection line 3 is electrically connected to the electrical connection element 24. By the connection manner above, the electrical connection elements 24 and the connection lines 3 are electrically connected. The electrical connection elements 24 are disposed on the light source substrate 22, and a connection between the connection lines 3 and the electrical connection elements 24 is a plug-in connection, and therefore, the electrical connection between the light source substrate 22 and the connection lines 3 can be quickly achieved.

In other alternative examples, the electrical connection elements 24 can also be conductive strips disposed on the light source substrate 22, and the connection line 3 is directly welded on the light source substrate 22 to achieve electrical connection between the light source substrate 22 and the connection line 3, and the amount of conductive strips is the same as the amount of the wires in the connection line 3.

As shown in FIG. 3, FIG. 4, and FIG. 6 to FIG. 10, the light distribution element 25 has a lid shape, and can be made of insulating and transparent plastic materials (such as PC, PMMA). The light distribution element 25 is integrally formed by injection molding technology. The light distribution element 25 on the light source module 2 also serves as an electrical insulation housing, which improves the safety level. The light distribution element 25 is configured to perform secondary light distribution on the light emitted from the light source 23, in other words, the light distribution element 25 is used for adjusting the optical path. In the present example, the light distribution element 25 is a type of lens. The light distribution element 25 is substantially the same in configuration as the base 21 and the light source substrate 22. The light distribution element 25 is snap-connected to the base 21, and the light source substrate 22 is interposed between the light distribution element 25 and the base 21. Certainly, in other alternative examples, the light distribution element 25 may also be directly connected to the light source substrate 22, or the light distribution element 25 may be connected to both the light source substrate 22 and the base 21. By various connection methods above, the base 21, the light source substrate 22, and the light distribution element 25 are connected together.

A center of the light distribution element 25 is provided with a second through hole 251 penetrating an upper surface and a lower surface of the light distribution element 25. The second through hole 251 corresponds to the first through hole 211 and the hollow positioning post 111, and the second through hole 251 is a stepped hole. Thus, in a case where the light source module 2 is assembled to the bottom wall 11 of the housing 1, the positioning post 111 extends into the first through hole 211 and the second through hole 251 in sequence, so that the light source module 2 is pre-positioned to the bottom wall 11 of the housing 1. Meanwhile, a screw (not shown) can be received in the hollow positioning post 111, so that the light source module 2 is locked onto the bottom wall 11 of the housing 1.

Figure 8:
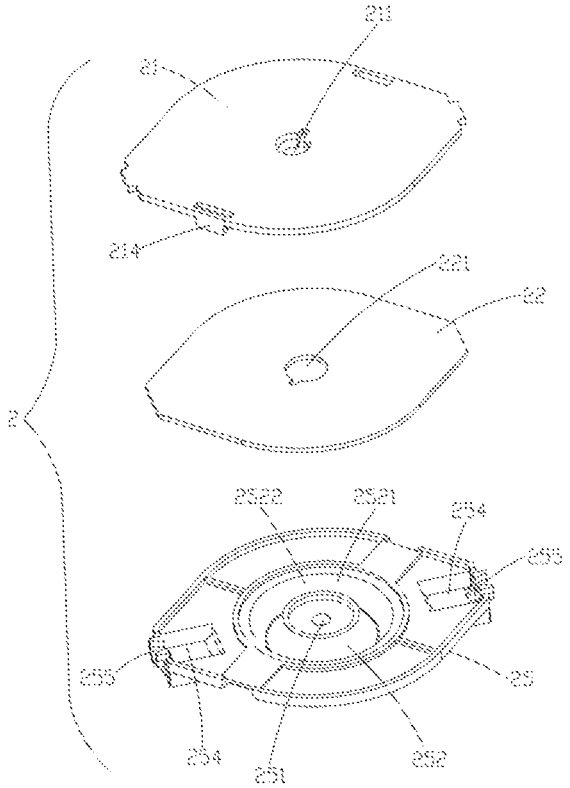
FIG. 8 is a schematic view of another angle of FIG. 7.
Figure 9:
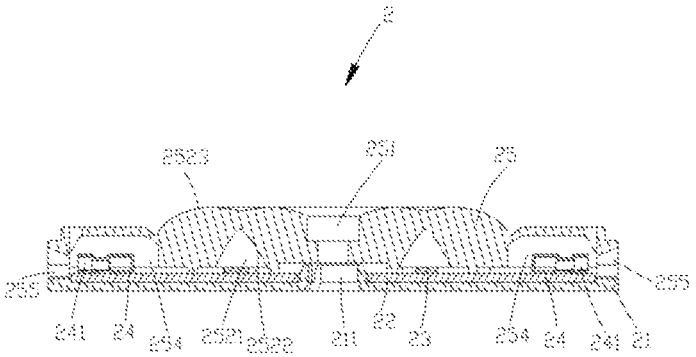
FIG. 9 is a cross-sectional view taken along line A-A of FIG. 5.
Figure 10:
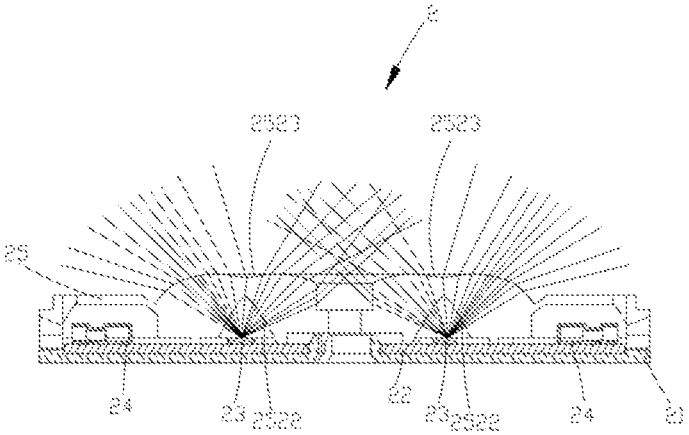
FIG. 10 is a corresponding optical path diagram of a light distribution element shown in FIG. 9.

A light distribution portion 252 corresponding to the plurality of light sources 23 on the light source substrate 22 is disposed on an intermediate region of the light distribution element 25, and the light distribution portion 252 is annular and in an arched shape. The light distribution portion 252 can perform secondary light distribution on the light emitted from the light sources 23. Further, the lower surface of the light distribution portion 252 is provided with a recessed groove 2521 which is in an annular shape, and the plurality of light sources 23 correspond to the recessed groove 2521, and the shapes of respective cross sections of the light distribution portion 252 in an extending direction are uniform. As shown in FIG. 8, the recessed groove 2521 has a bottom surface 2522 having a substantially triangular cross section, and the bottom surface 2522 is a light incident surface. The upper surface 2523 of the light distribution portion 252 is a light exit surface. Further, the curvature of the light incident surface 2522 is greater than the curvature of the light exit surface 2523, that is, the light incident surface 2522 is more curved than the light exit surface 2523. In addition, the edge of the light distribution element 25 is provided with a fixture block 253 that cooperates with the snap-fit portion 214 on the base 21. The bottom surface of the light distribution element 25 is further provided with a receiving groove 254 for accommodating the electrical connection element 24 and an opening 255 that connects with the receiving groove 254 and is used to enable the connection line 3 to extend into the light distribution element 25. It should be noted that, the receiving groove 254 corresponds to the electrical connection element 24.

In a case where the light distribution element 25 is connected to the base 21, the electrical connection element 24 is accommodated in the receiving groove 254. The above opening 255 can also be regarded as an opening on the light source module 2 into which the connection line 3 can extend. The opening 255 is in a flared shape, so that the connection lines 3 can be inserted conveniently. As shown in FIG. 3, FIG. 4, FIG. 6, FIG. 7, and FIG. 9, the plurality of connection lines 3 electrically connect the plurality of light source modules 2. In the present example, at least one end of each connection line 3 is directly inserted into the receiving channel 241 of the electrical connection element 24 in the light source module 2, so that the connection line 3 is electrically connected to the electrical connection element 24. The plurality of light source modules 2 are electrically connected together through the connection of the connection lines 3. It should be noted that, for two connection lines of the plurality of connection lines 3, one end of each of the two connection lines is connected to the electrical connection element 24, and the other end is connected to the driving power source. It should be noted that, each connection line 3 only includes one wire. In addition, in order to better position the connection lines 3 to the bottom wall 11 of the housing 1, the illumination device 100 further includes adhesive members or limit members for positioning the connection lines 3 to the bottom wall 11 of the housing 1.

Compared with the other solutions in which the light sources in the illumination device are arranged on a whole substrate, the illumination device 100 according to the example of the present disclosure includes a plurality of light source modules 2 that are electrically connected through connection lines 3, and each light source module 2 has the characteristics of miniaturization and modularization. Therefore, in a case where a certain light source module 2 in the illumination device 100 is damaged, only the certain light source module 2 needs to be directly replaced, and the entire light sources in the illumination device do not need to be replaced, thereby reducing the maintenance cost of the illumination device 100. At the same time, the electrical connection between the connection lines 3 and the light source modules 2 in the illumination device 100 is a plug-in connection, and the routing of the connection lines 3 is also simple, so the assembly process of the illumination device 100 is simple.

Figure 11:
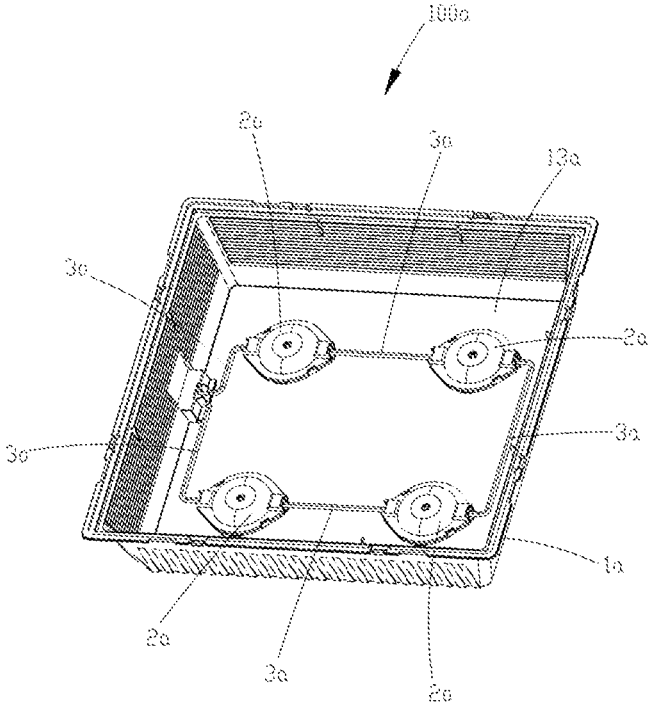
FIG. 11 is a perspective view of an illumination device according to a second example of the present disclosure.
Figure 12:
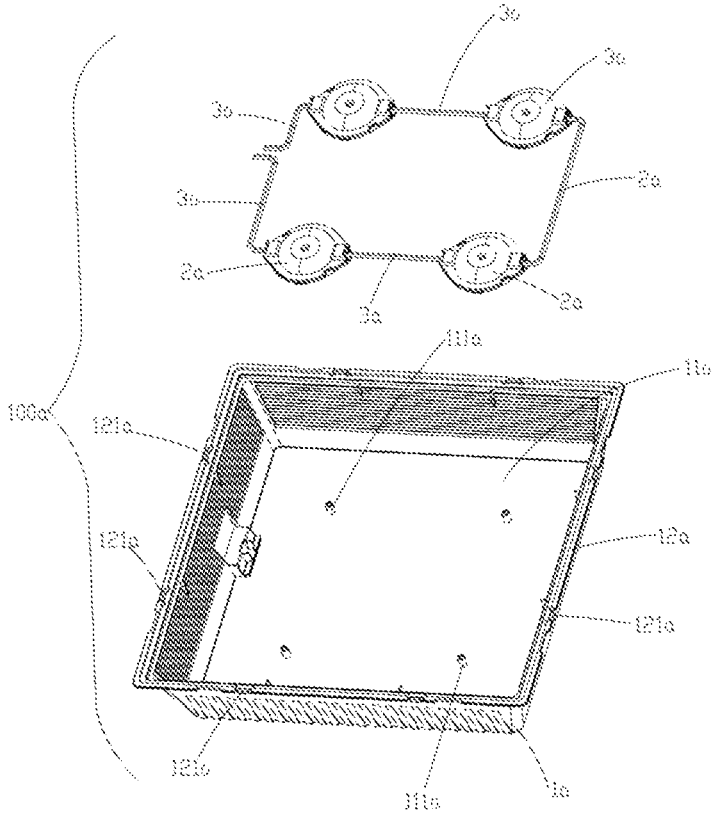
FIG. 12 is an exploded view of an illumination device according to a second example of the present disclosure.
Figure 13:
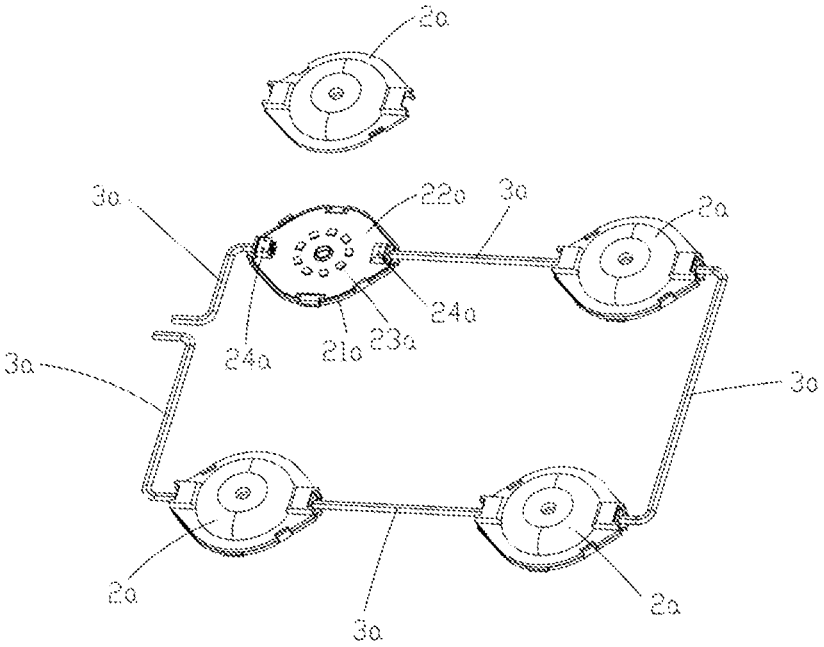
FIG. 13 is a perspective view of light source modules and connection lines in an illumination device according to a second example of the present disclosure.
Figure 14:
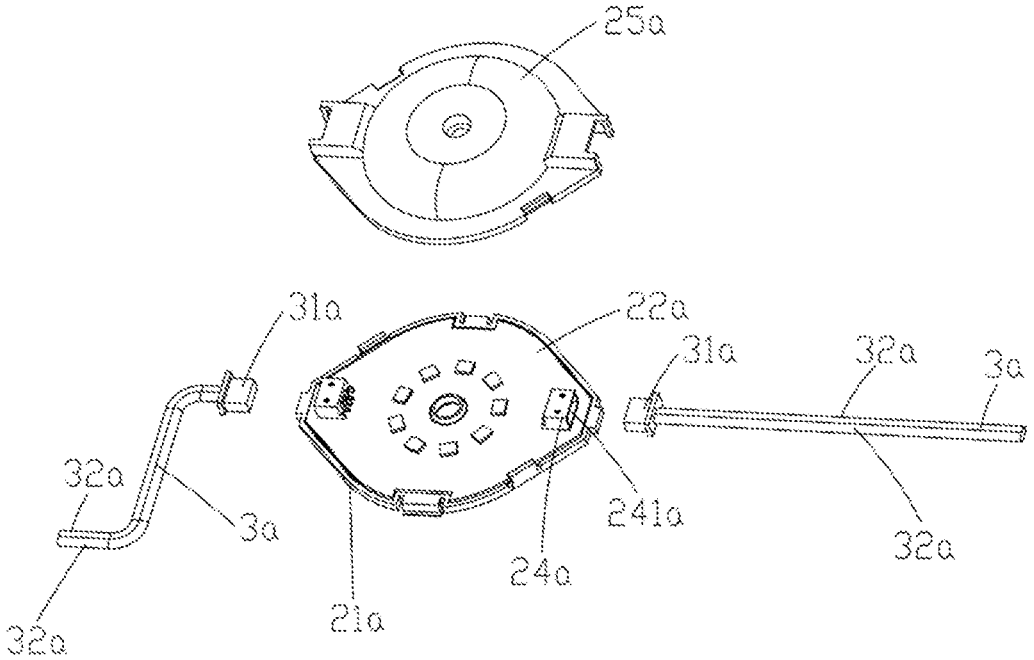
FIG. 14 is another perspective view of the light source modules and the connection lines of FIG. 13.
Figure 15:
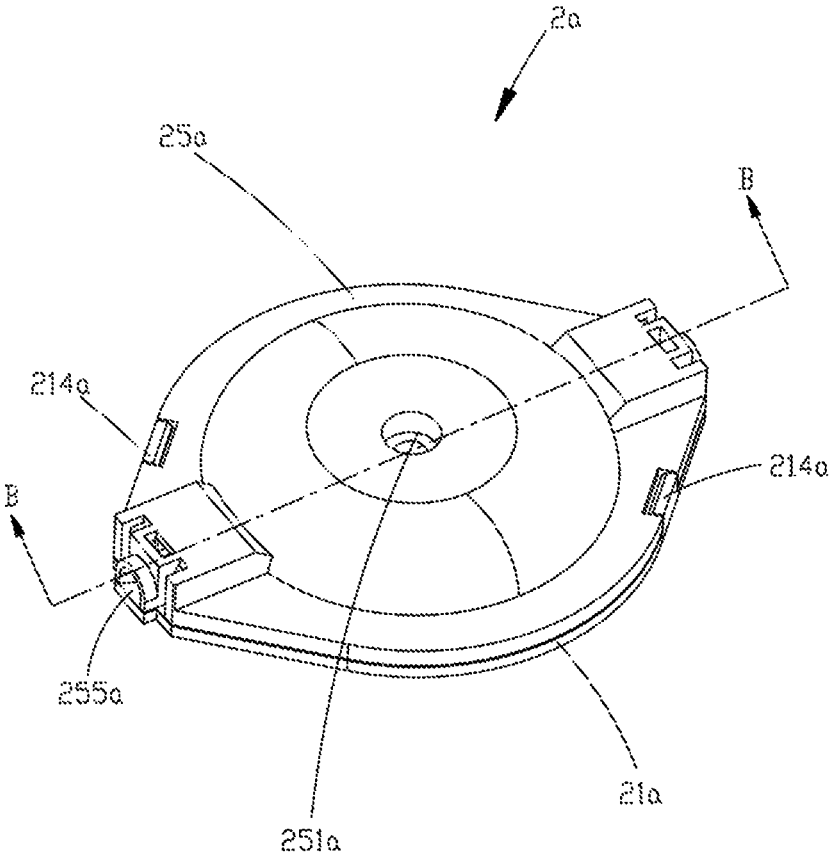
FIG. 15 is a perspective view of a light source module in an illumination device according to a second example of the present disclosure.
Figure 16:
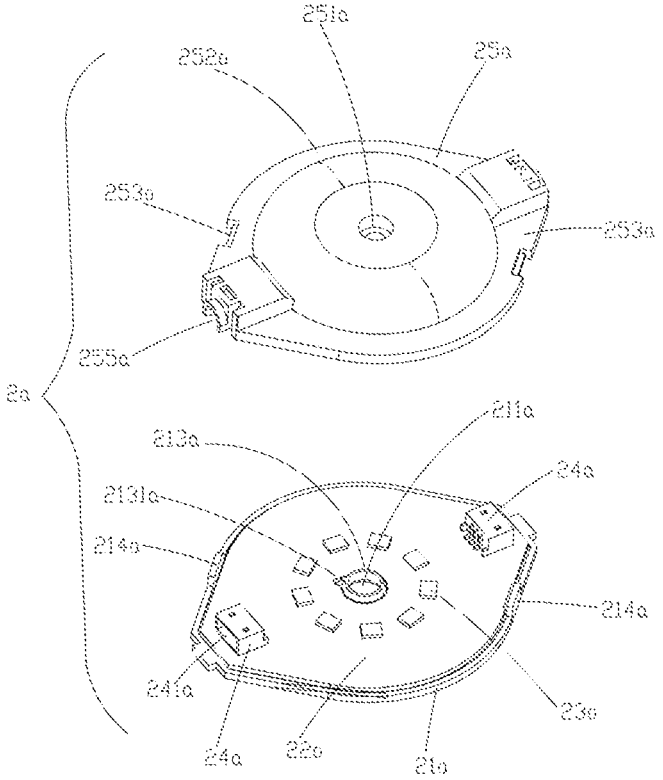
FIG. 16 is a partial exploded perspective view of FIG. 15.
Figure 17:
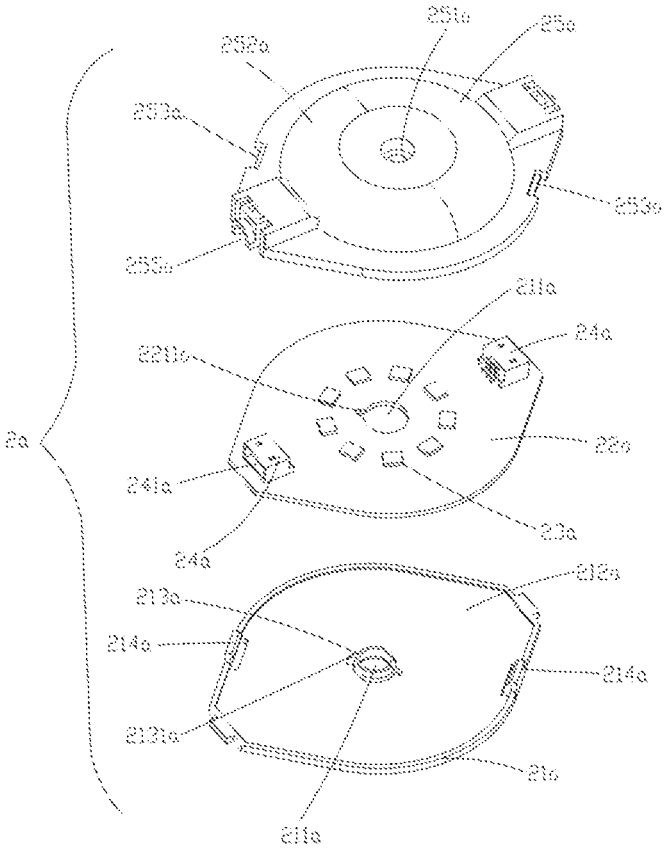
FIG. 17 is another exploded perspective view of FIG. 15.

For the second example, as shown in FIG. 11 to FIG. 12, an illumination device 100*a* provided by the second example of the present disclosure includes a housing 1*a*, a plurality of light source modules 2*a* received and fixed in the housing 1*a*, a plurality of connection lines 3*a* that electrically connect the plurality of light source modules 2*a*, and a lampshade (not shown) that is assembled to the housing 1*a* and used to seal the light source modules 2*a* and the connection lines 3*a* in the housing 1*a*. Further, the illumination device 100*a* further includes a driving power source (not shown) electrically connected to the plurality of light source modules 2*a*, and the driving power source may be disposed inside the housing 1*a* or may also be disposed outside the housing 1*a*. The illumination device 100*a* provided in the present example can be a kitchen-toilet lamp, a ceiling lamp or a decorative lamp. The structures of respective elements in the illumination device 100*a* and the connection relationships therebetween are described in detail in the following description.

As shown in FIG. 11 to FIG. 12, the housing 1*a* may be made of an insulating material, and includes a bottom wall 11*a* and a side wall 12*a* extending upward from an edge of the bottom wall 11*a*. The housing 1*a* is provided with an accommodation space 13*a* for accommodating the light source modules 2*a* and the connection lines 3*a*. Further, the bottom wall 11*a* of the housing 1*a* is provided with positioning posts 111*a* for pre-positioning the light source modules 2*a*. A plurality of latching portions 121*a* that can be connected to the lampshade are provided on an edge of the side wall 12*a* of the housing 1*a*. It should be noted that the positioning post 111*a* is hollow.

As shown in FIG. 11 and FIG. 12, the light source modules 2*a* are mounted on the bottom wall 11*a* of the housing 1*a*. In the present example, a fixed connection between the light source modules 2*a* and the bottom wall 11*a* of the housing 1*a* can be achieved by screws (not shown). In other alternative examples, the fixed connection between the light source modules 2*a* and the bottom wall 11*a* can also be achieved by a snap-fit structure (not shown), or glue, or a magnetic element. The light source modules 2*a* in the present example have the characteristics of miniaturization and modularization and are convenient for replacement.

As shown in FIG. 13 to FIG. 20, the light source module 2*a* includes a base 21*a*, a light source substrate 22*a* disposed on the base 21*a*, and a plurality of light sources 23*a* disposed on the light source substrate 22*a*, and electrical connection elements 24*a* disposed at two ends of the light source substrate 22*a*, and a light distribution element 25*a* connected to the base 21*a*. The light source substrate 22*a* is disposed between the light distribution element 25*a* and the base 21*a*.

As shown in FIG. 13, FIG. 14, and FIG. 16 to FIG. 20, the base 21*a* is made of an insulating material and has a substantially elliptical shape. A first through hole 211*a* is disposed in a central region of the base 21*a*, and the first through hole 211*a* penetrates an upper surface and a lower surface of the base 21*a*. Further, the upper surface of the base 21*a* is provided with a recessed groove 212*a* for accommodating the light source substrate 22*a*. The base 21*a* is also provided with a positioning convex rib 213*a* located inside the recessed groove 212*a*. In other alternative examples, a recessed groove 212*a* may not be provided within the base 21*a* described above. The positioning convex rib 213*a* is substantially annular and disposed around the first through hole 211*a*, and the positioning convex rib 213*a* is used for pre-positioning the light source substrate 22*a*. In addition, snap-fit portions 214*a* for cooperating with the light distribution element 25*a* are provided on the outer edge of the base 21*a*. In other alternative implementations, the fixed connection between the base 21*a* and the light distribution element 25*a* can also be achieved by screws (not shown).

As shown in FIG. 13, FIG. 14, and FIG. 16 to FIG. 20, the light source substrate 22*a* may be a printed circuit board, and the printed circuit board has conductive lines. A configuration of the light source substrate 22*a* on a horizontal plane may be substantially the same as the base 21*a* and light distribution element 25*a*. The light source substrate 22*a* is substantially elliptical. The light source substrate 22*a* is provided with a positioning hole 221*a* that cooperates with the positioning convex rib 213*a* on the base 21*a*. The positioning convex rib 213*a* on the base 21*a* and the inner sidewall of the positioning hole 221*a* on the light source substrate 22*a* are interference-fitted with each other, so that the light source substrate 22*a* and the base 21*a* are positioned with respect to each other. Further, the positioning hole 221*a* is further provided with an extending groove 2211*a* that extends radially, and the extending groove 2211*a* may cooperate with a limiting portion 2131*a* on the positioning convex rib 213*a*. It should be noted that the cooperation of the extending groove 2211*a* and the limiting portion 2131*a* can prevent the light source substrate 22*a* from rotating relative to the base 21*a*, and the limiting portion 2131*a* can also play a role of fool-proof.

As shown in FIG. 13, FIG. 14, and FIG. 16 to FIG. 20, the light source 23*a* can be an LED light source, i.e., an LED light-emitting unit, and can be mounted on the upper surface of the light source substrate 22*a* through surface mount technology (SMT) or Through Hole Technology (THT). The plurality of light sources 23*a* are electrically connected to each other through the conductive lines on the light source substrate 22*a*. The plurality of light sources 23*a* are evenly distributed on the periphery of the positioning hole 221*a* in the circumferential direction. The specific position and the specific amount of the light sources 23*a* can be adjusted according to actual lighting requirements.

In the present example, the plurality of light sources 23*a* on the light source substrate 22*a* can be two-color-temperature light sources. Specifically, the two-color-temperature light sources refer to the plurality of light sources 23*a* on the source base board 22*a* including two parts of light sources, that is, a plurality of first light sources and a plurality of second light sources, where the plurality of first light sources correspond to one color-temperature value, and the plurality of second light sources correspond to another color-temperature value. Furthermore, the two-color-temperature light sources 23*a* have three illumination effects, that is, a first illumination effect presented in a case where the plurality of first light sources are lit separately, a second illumination effect presented in a case where the plurality of second light sources are lit separately, and a third illumination effect presented in a case where all the light sources 23*a* are lit. The plurality of first light sources and the plurality of second light sources can be spaced apart from each other in the circumferential direction.

As shown in FIG. 13, FIG. 14, and FIG. 16 to FIG. 20, in the present example, the electrical connection elements 24*a* are connectors, and are electrically connected to both ends of the light source substrate 22*a* by a soldering method. The electrical connection element 24*a* has a receiving cavity 241*a*. One end of a connection line 3*a* is accommodated in the receiving cavity 241*a*, that is, one end of the connection line 3*a* is plugged to the electrical connection element 24*a*, so that the electrical connection elements 24*a* and the connection lines 3*a* are electrically connected. By providing the electrical connection elements 24*a* on the light source substrate 22*a*, the electrical connection between the light source substrate 22*a* and the connection lines 3*a* can be achieved. The electrical connection element 24*a* includes a first insulating body (not shown) and first terminals (not shown) that are assembled to the first insulating body and are electrically connected to the light source substrate 22*a*.

As shown in FIG. 13, FIG. 14, and FIG. 16 to FIG. 20, the light distribution element 25*a* is in a lid shape, and can be made of insulating and transparent plastic materials (such as PC, PMMA). The light distribution element 25*a* is integrally formed by injection molding technology. The light distribution element 25*a* on the light source module 2*a* also serves as an electrical insulation housing, which improves the safety level. The light distribution element 25*a* is configured to perform secondary light distribution on the light emitted from the light source 23*a*. In other words, the light distribution element 25*a* is used for adjusting the optical path. In the present example, the light distribution element 25*a* is a type of lens. The light distribution element 25*a* is substantially the same in configuration as the base 21*a* and the light source substrate 22*a*. The light distribution element 25*a* is snap-connected to the base 21*a*, and the light source substrate 22*a* is sandwiched between the light distribution element 25*a* and the base 21*a*. In other alternative examples, the light distribution element 25*a* may also be directly connected to the light source substrate 22*a*, or the light distribution element 25*a* may be connected to both the light source substrate 22*a* and the base 21*a*. By various connection methods above, the base 21*a*, the light source substrate 22*a*, and the light distribution element 25*a* are connected together.

A center of the light distribution element 25*a* is provided with a second through hole 251*a* penetrating an upper surface and a lower surface of the light distribution element 25*a*. The second through hole 251*a* corresponds to the first through hole 211*a* and the hollow positioning post 111, and the second through hole 251*a* is a stepped hole. Thus, in a case where the light source modules 2*a* are assembled to the bottom wall 11*a* of the housing 1*a*, the positioning posts 111*a* sequentially extend into the first through hole 211*a* and the second through hole 251*a*, so that the light source modules 2*a* are pre-positioned to the bottom wall 11*a* of the housing 1*a*. Meanwhile, screws (not shown) can be received in the hollow positioning posts 111*a*, so that the light source modules 2*a* are locked onto the bottom wall 11*a* of the housing 1*a*.

Figure 18:
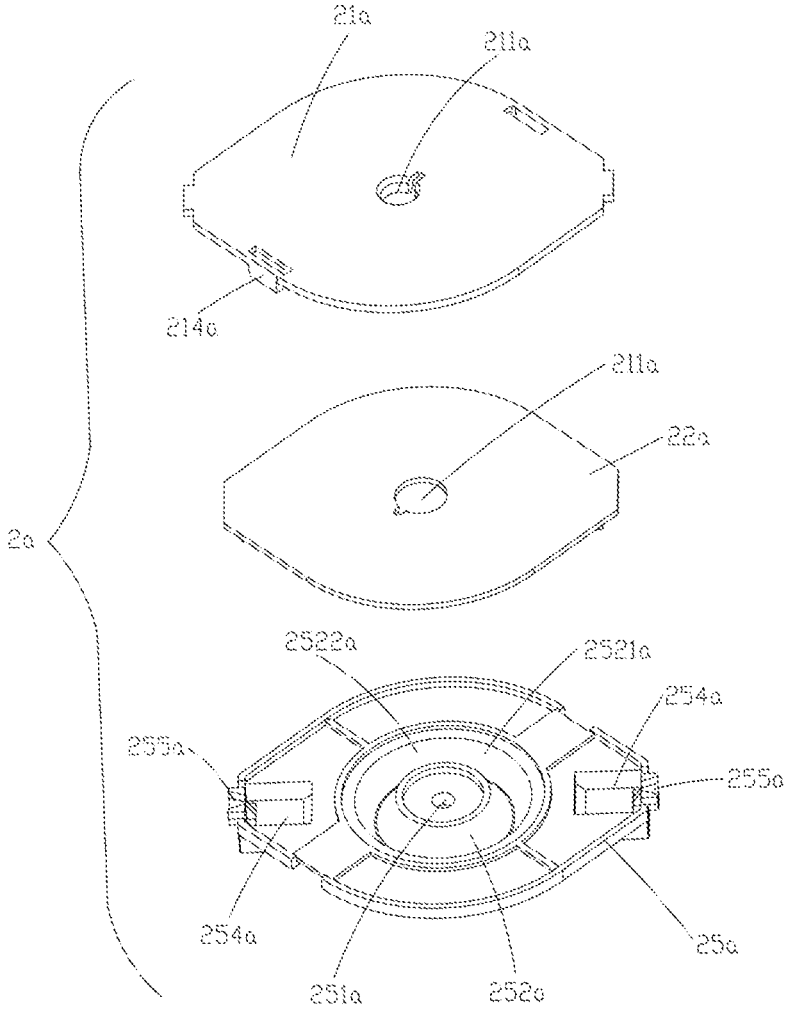
FIG. 18 is a schematic view of another angle of FIG. 17.
Figure 19:
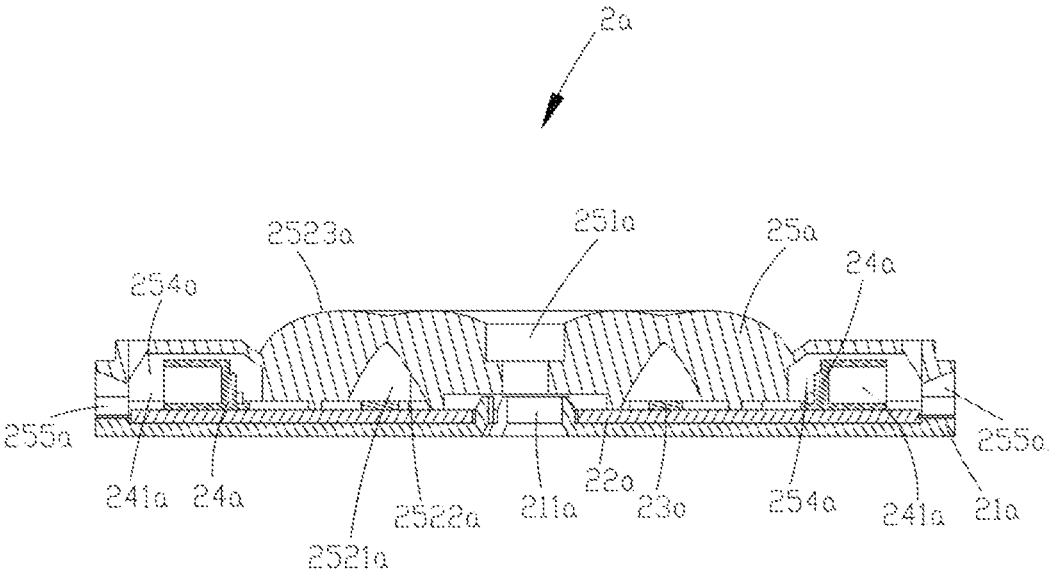
FIG. 19 is a cross-sectional view taken along line B-B of FIG. 15.
Figure 20:
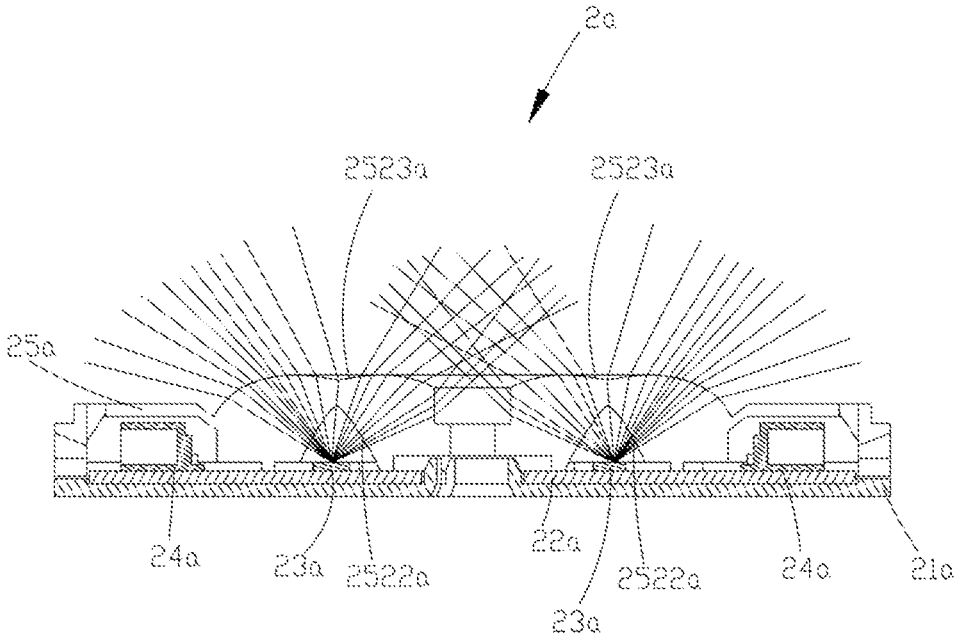
FIG. 20 is a corresponding optical path diagram of a light distribution element shown in FIG. 19.
Figure 21:
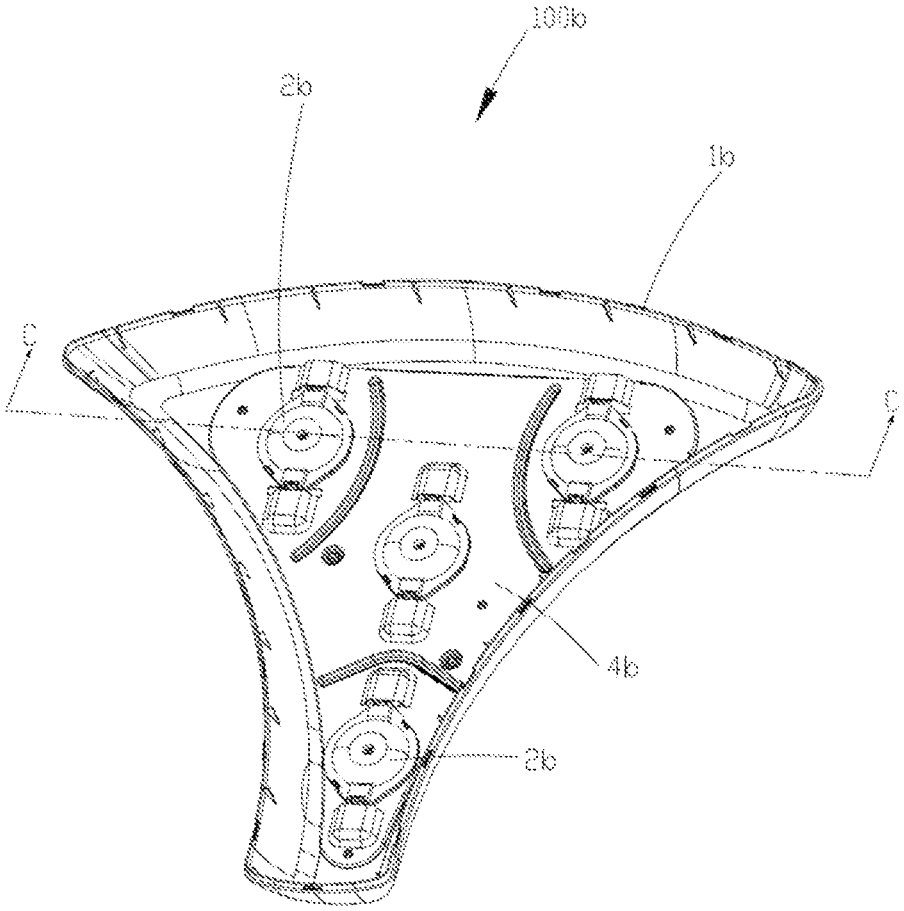
FIG. 21 is a perspective view of an illumination device according to a third example of the present disclosure.
Figure 22:
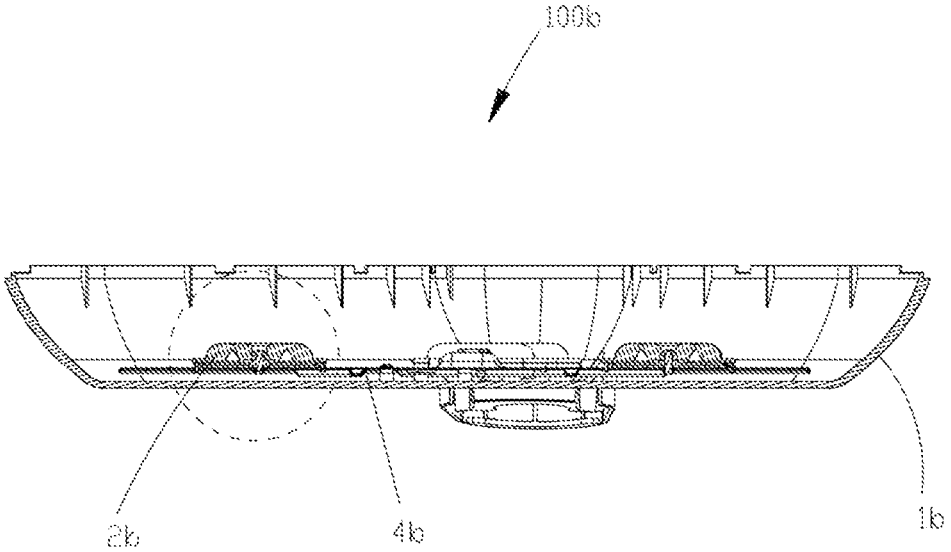
FIG. 22 is a cross-sectional view taken along line C-C in FIG. 21.
Figure 23:
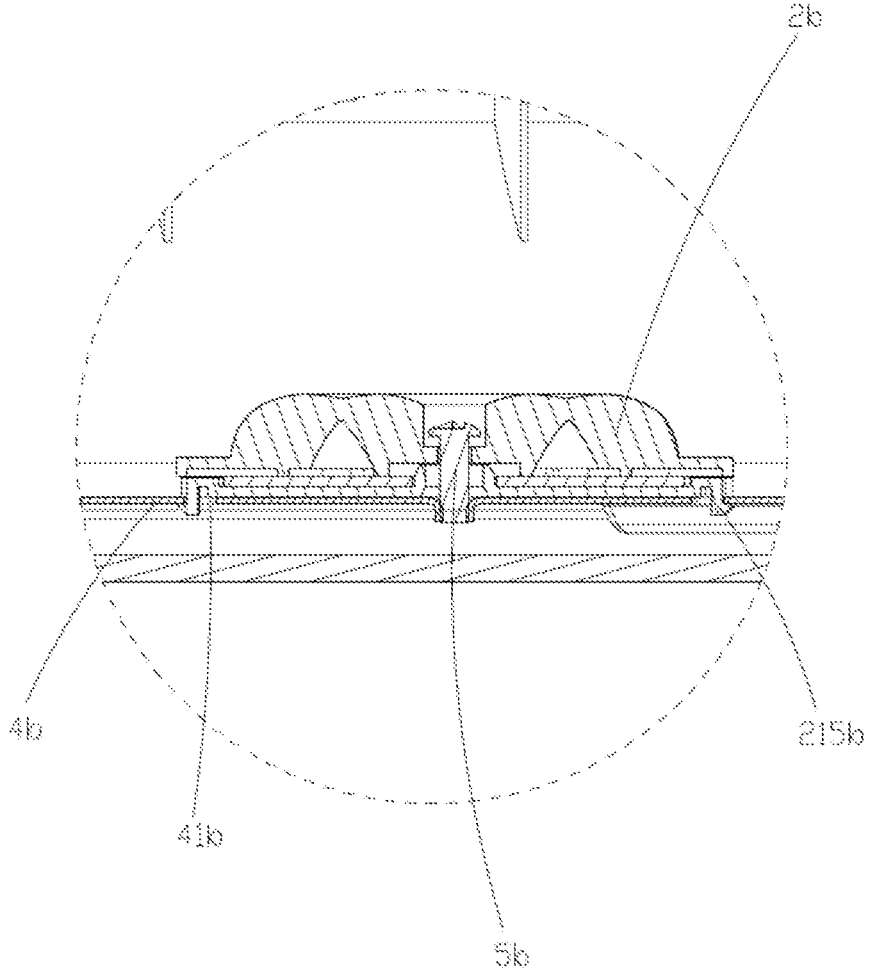
FIG. 23 is a partial enlarged view of FIG. 22.
Figure 24:
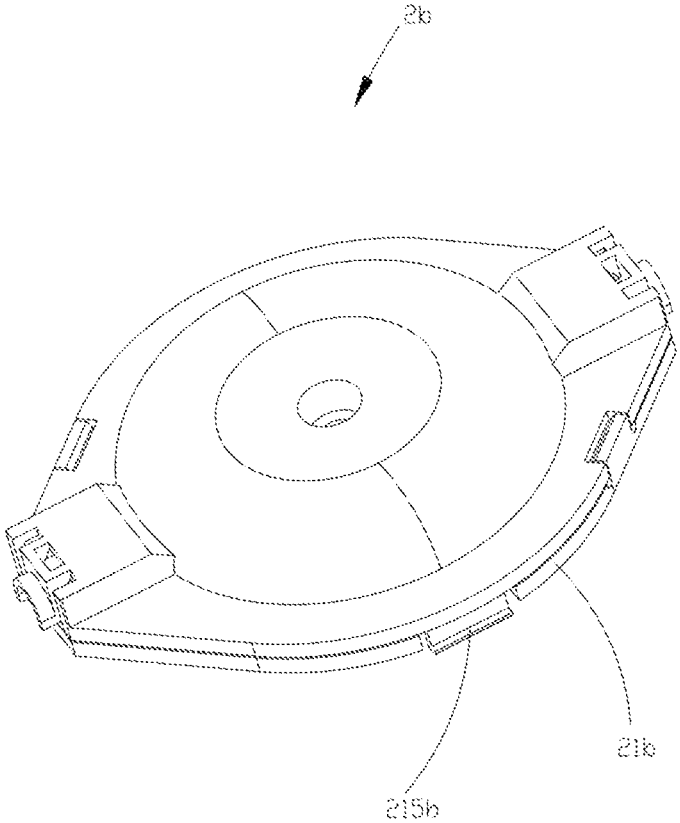
FIG. 24 is a perspective view of a light source module in an illumination device shown in FIG. 21.

A light distribution portion 252*a* corresponding to the plurality of light sources 23*a* on the light source substrate 22*a* is provided on an intermediate region of the light distribution element 25*a*, and the light distribution portion 252*a* is annular and in an arched shape. The light distribution portion 252*a* can perform secondary light distribution on the light emitted from the light sources 23*a*. Further, the lower surface of the light distribution portion 252*a* is provided with a recessed groove 2521*a* which is annular, and the plurality of light sources 23*a* correspond to the recessed groove 2521*a*, and the shapes of respective cross sections of the light distribution portion 252*a* in the extending direction are uniform. As shown in FIG. 18, the recessed groove 2521*a* has a bottom surface 2522*a* having a substantially triangular cross section, and the bottom surface 2522*a* is a light incident surface. The upper surface 2523*a* of the light distribution portion 252*a* is a light exit surface. Further, the curvature of the light incident surface 2522*a* is greater than the curvature of the light exit surface 2523*a*. In other words, the light incident surface 2522*a* is more curved than the light exit surface 2523*a*.

In addition, the edge of the light distribution element 25*a* is provided with a fixture block 253*a* that cooperates with the snap-fit portion 214*a* on the base 21*a*. The bottom surface of the light distribution element 25*a* is further provided with a receiving groove 254*a* and an opening 255*a*, and the receiving groove 254*a* is used for accommodating the electrical connection element 24*a*, and the opening 255*a* connects with the receiving groove 254*a* and is used to enable the connection line 3*a* to extend into the light distribution element 25*a*. It should be noted that, the receiving groove 254*a* corresponds to the electrical connection element 24*a*. In a case where the light distribution element 25*a* is connected to the base 21*a*, the electrical connection element 24*a* is accommodated in the receiving groove 254*a*. The above opening 255*a* can also be regarded as an opening on the light source module 2*a* into which the connection line 3*a* can extend. The opening 255*a* is in a flared shape, so that the connection lines 3 can be inserted conveniently.

As shown in FIG. 13, FIG. 14, and FIG. 16 to FIG. 20, the plurality of connection lines 3*a* electrically connect the plurality of light source modules 2*a*. In the present example, at least one end of each connection line 3*a* is inserted into the receiving channel 241*a* of the electrical connection element 24*a* in the light source module 2*a*, so that the connection line 3*a* is electrically connected to the electrical connection element 24*a*. Through the connection of the connection lines 3*a*, the plurality of light source modules 2*a* are electrically connected together. It should be noted that, for two connection lines of the plurality of connection lines 3*a*, one end of each of the two connection lines is connected to the electrical connection element 24*a*, and the other end is connected to the driving power source. It should be noted that, each connection line 3*a* includes two wires 32*a*, one of the two wires 32*a* can be electrically connected to a first light source in the light sources 23*a*, and the other one of the two wires 32*a* can be electrically connected to a second light source in the light sources 23*a*.

In the present example, one end of each connection line 3*a* is provided with a docking connector 31*a* which cooperates and is docked with the electrical connection element 24*a*, and the docking connector 31*a* is plugged into the electrical connection element 24*a*, so that the connection lines 3*a* can be quickly connected to the light source modules 2*a*. The docking connector 31*a* includes a second insulating body (not shown) and second terminals mounted in the second insulating body. The first terminal and the second terminal in the electrical connection element 24*a* are in contact with each other to achieve electrically connection. In other alternative examples, the electrical connection elements 24*a* may also be conductive strips disposed on the light source substrate 22*a*, and the connection lines 3*a* are directly soldered to the light source substrate 22*a* to achieve electrical connection between the light source substrate 22*a* and the connection lines 3*a*. The amount of the conductive strips is the same as the amount of wires in the connection line 3*a*. In addition, in order to better position the connection lines 3*a* to the bottom wall 11*a* of the housing 1*a*, the illumination device 100*a* further includes adhesive members or limit members for positioning the connection lines 3*a* to the bottom wall 11*a* of the housing 1*a*.

It should be noted that, in other alternative examples, the amount of wires in the connection line may also be multiple, such as three. To correspond to the amount of wires in the connection line, the light sources in the light source modules also comprise three light source, e.g., light source that can emit red, green, and blue, respectively. Thus, depending on different external input power routings, the illumination device can achieve a variety of illumination effects.

Compared with the other solutions in which the light sources in the illumination device are arranged on a whole substrate, the illumination device 100*a* according to the example of the present disclosure includes a plurality of light source modules 2*a* that are electrically connected through connection lines 3*a*, and each light source module 2*a* has the characteristics of miniaturization and modularization. Therefore, in a case where a certain light source module 2*a* in the illumination device 100*a* is damaged, only the certain light source module 2*a* needs to be directly replaced, and the entire light sources in the illumination device do not need to be replaced, thereby reducing the maintenance cost of the illumination device 100*a*. At the same time, the electrical connection between the connection lines 3*a* and the light source modules 2*a* in the illumination device 100*a* is a plug-in connection, and the routing of the connection lines 3*a* is also simple, so the assembly process of the illumination device 100*a* is simplified.

For the third example, as shown in FIG. 21 to FIG. 24, an illumination device 100*b* according to the third example of the present disclosure includes a housing 1*b*, a plurality of light source modules 2*b* accommodated and fixed in the housing 1*b*, and a plurality of connection lines (not shown) that electrically connect the plurality of light source modules 2*b*, and a lampshade (not shown) that is assembled to the housing 1*b* and used to seal the plurality of light source modules 2*b* and the connection lines in the housing 1*b*. The illumination device 100*b* further includes a fixing member 4*b* fixed in the housing 1*b*, and the plurality of light source modules 2*b* are snapped onto the fixing member 4*b*. The fixing member 4*b* is provided with a fixing hole 41*b* for fixing the light source modules 2*b*. The light source modules 2*b* in the present example has substantially the same structure as the light source modules 2, 2*a* in the first and second examples of the present disclosure, and a base 21*b* of the light source module 2*b* is provided with a snap-fit portion 215*b* that is snap-connected to the housing 1*b* or the fixing member 4*b*. Specifically, the snap-fit portion 215*b* passes through the fixing hole 41*b* and is snap-connected to the fixing member 4*b*. In this way, the light source module 2*b* is fixed to the housing 1*b* by both a screw 5*b* and is also fixed to the housing 1*b* by the snap-fit portion 215*b*, so that the light source module 2*b* can be stably fixed in the housing 1*b*. In the case where there is no strict and high requirements for the stability of the light source modules 2*b*, in the light source modules 2*b*, only the snap-fit portion 215*b* needs to be directly snap-connected to the housing 1*b* or the snap-fit portion 215*b* is directly snap-connected to the fixing member of the housing 1*b*, so as to achieve the connection requirements.

Figure 25:
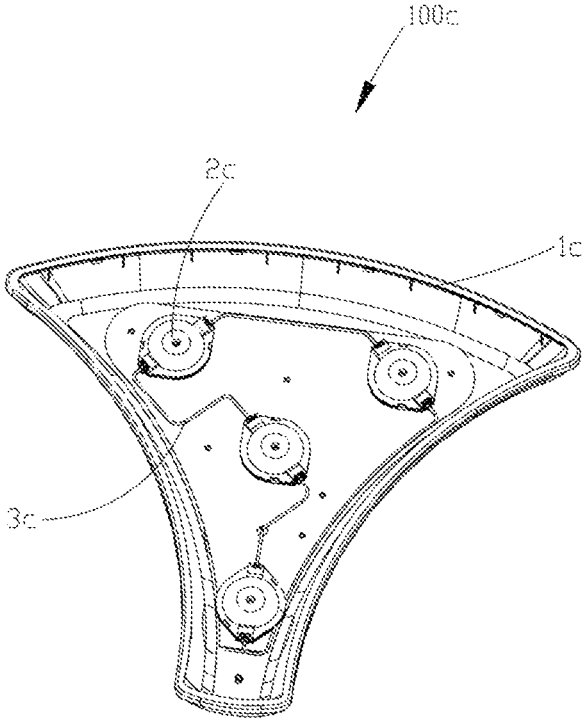
FIG. 25 is a perspective view of an illumination device according to a fourth example of the present disclosure.

For the fourth example, as shown in FIG. 25, an illumination device 100*c* according to the fourth example of the present disclosure includes a housing 1*c*, a plurality of light source modules 2*c* received and fixed in the housing 1*c*, and a plurality of connection lines 3*c* that electrically connect the plurality of light source modules 2*c*, and a lampshade (not shown) that is assembled to the housing 1*c* and used to seal the plurality of light source modules 2*c* and the connection lines 3*c* in the housing 1*c*. It should be noted that a shape of the housing 1*c* is irregular, and therefore, the plurality of light source modules 2*c* are evenly distributed in the housing 1*c* according to the shape of the housing 1*c* to ensure the uniformity of the light emitted from the illumination device 100*c*.

Figure 26:
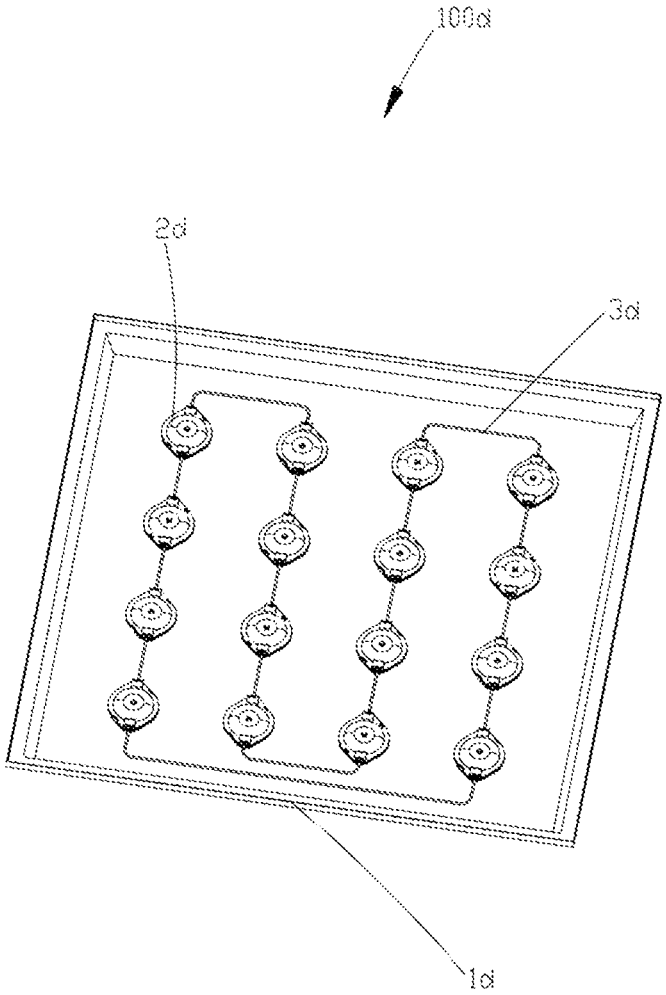
FIG. 26 is a perspective view of an illumination device according to a fifth example of the present disclosure.

For the fifth example, as shown in FIG. 26, an illumination device 100*d* according to the fifth example of the present disclosure includes a housing 1*d*, a plurality of light source modules 2*d* received and fixed in the housing 1*d*, and a plurality of connection lines 3*d* that electrically connect the plurality of light source modules 2*d*, and a lampshade (not shown) that is assembled to the housing 1*d* and used to seal the plurality of light source modules 2*d* and the connection lines 3*d* in the housing 1*d*. It should be noted that a shape of the housing 1*d* is square, and the plurality of light source modules 2*d* are evenly distributed in the housing 1*d* according to the shape of the housing 1*d* to ensure the uniformity of the light emitted from the illumination device 100*d*.

The present disclosure provides an illumination device which is low in maintenance cost and convenient in assembly.

The present disclosure provides an illumination device which may include a housing, a plurality of light source modules positioned in the housing, and a plurality of connection lines electrically connecting the plurality of light source modules. Each of the light source modules comprises a base, a light source substrate provided on the base, a plurality of light sources provided on the light source substrate, electrical connection elements provided on the light source substrate, and a light distribution element connected with the base and/or the light source substrate; the light source substrate and the electrical connection elements are disposed between the light distribution element and the base; and the connection lines and the electrical connection elements are electrically connected.

Further, the plurality of light sources are monochromatic-temperature light sources, and the connection line comprises a wire, and at least one end of the wire is electrically connected to the light source substrate.

Further, the plurality of light sources are two-color-temperature light sources, and the connection line comprises two wires, and at least one end of the two wires is electrically connected to the light source substrate.

Further, the plurality of light sources are multiple-color-temperature light sources, and the connection line comprises a plurality of wires, and at least one end of the plurality of wires is electrically connected to the light source substrate.

Further, the electrical connection elements are conductive terminals, each of the electrical connection elements has a receiving channel and a contact arm extending into the receiving channel, and one end of a connection line is inserted into the receiving channel and is in contact with the contact arm.

Further, each of the electrical connection element is a connector, one end of each of the connection lines is provided with a docking connector, and the connector cooperates with the docking connector in a plug-in manner.

Further, the connector comprises a first insulating body and first terminals mounted within the first insulating body, and the docking connector comprises a second insulating body and second terminals mounted within the second insulating body, an amount of the first terminals, an amount of the second terminals and an amount of wires in the connection line are same.

Further, the base is provided with a first through hole penetrating an upper surface and a lower surface of the base, a recessed groove for accommodating the light source substrate and a positioning convex rib located in the recessed groove, the light source substrate is provided with a positioning hole that cooperates with the positioning convex rib.

Further, the base is further provided with a snap-fit portion that is snap-connected to the light distribution element, and the light distribution element is provided with a second through hole corresponding to the first through hole.

Further, the second through hole is a stepped hole.

Further, the plurality of light sources are arranged in a circumferential direction, and the positioning hole is located inside the plurality of light sources.

Further, the light distribution element is provided with a light distribution portion corresponding to the plurality of light sources, and a lower surface of the light distribution portion is provided with a recessed groove which is in an annular shape, and the plurality of light sources correspond to the recessed groove, and shapes of respective cross sections of the light distribution portion in an extending direction are uniform.

Further, the recessed groove has a bottom surface which is in a triangular shape, the bottom surface is a light incident surface, and an upper surface of the light distribution portion is a light exit surface.

Further, a bottom surface of the light distribution element is further provided with a receiving groove for accommodating the electrical connection elements and an opening that is communicated with the receiving groove and enables one end of the connection line to extend into the opening.

Further, the illumination device further comprises a driving power source electrically connected to the connection lines, and the driving power source is provided inside the housing or outside the housing.

Further, the housing is provided with a plurality of hollow positioning posts that cooperate with the light source modules, and the hollow positioning posts are accommodated in the first through hole and the second through hole.

Further, the illumination device further comprises screws that cooperate with the hollow positioning posts, and the screws fix the light source modules to the housing.

Further, the housing comprises a bottom wall and a side wall extending upward from an edge of the bottom wall, and the plurality of hollow positioning posts are disposed on the bottom wall.

Further, the base is provided with a snap-fit portion that is snap-connected to the housing.

Further, the illumination device further comprises a fixing member fixed in the housing, and the base is provided with a snap-fit portion that is snap-connected to the fixing member.

Compared with other examples, the illumination device provided by the example of the present disclosure comprises a plurality of light source modules which are electrically connected to each other through connection lines, and each light source module has the characteristics of miniaturization and modularization. Therefore, in a case where a certain light source module in the illumination device is damaged, only the light source module needs to be replaced directly, and the entire light sources in the illumination device do not need to be replaced, thereby reducing the maintenance cost of the illumination device.

The present disclosure also provides a method of manufacturing an illumination device. The method may include providing a housing, positioning a plurality of light source modules in the housing, and connecting a plurality of connection lines electrically with the plurality of light source modules, and where each of the light source modules comprises: a base, a light source substrate provided on the base, a plurality of light sources provided on the light source substrate, electrical connection elements provided on the light source substrate, and a light distribution element connected with the base and/or the light source substrate, and where the light source substrate and the electrical connection elements are between the light distribution element and the base, and the connection lines and the electrical connection elements are electrically connected.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The object, technical solution and beneficial effects of the present disclosure are described in detail with reference to the examples described above. It is to be understood that the above description is only examples of the present disclosure and is not intended to limit the present disclosure. Any modifications, equivalent substitutions, improvements, etc., that are made within the spirit and principle of the present disclosure, should be included in the scope of the present disclosure.

What is claimed is:

1. An illumination device, comprising:

a housing, a plurality of light source modules positioned in the housing, and a plurality of connection lines electrically connecting the plurality of light source modules, and wherein each of the light source modules comprises: a base, a light source substrate provided on the base, a plurality of light sources provided on the light source substrate, electrical connection elements provided on the light source substrate, and a light distribution element connected with the base and/or the light source substrate, and wherein the light source substrate and the electrical connection elements are between the light distribution element and the base, and the connection lines and the electrical connection elements are electrically connected.

2. The illumination device according to claim 1, wherein the plurality of light sources are monochromatic-temperature light sources, and each of the connection lines comprises a wire, and at least one end of the wire is electrically connected to the light source substrate.

3. The illumination device according to claim 1, wherein the plurality of light sources are two-color-temperature light sources, and each of the connection lines comprises two wires, and at least one end of the two wires is electrically connected to the light source substrate.

4. The illumination device according to claim 1, wherein the plurality of light sources are multiple-color-temperature light sources, and each of the connection lines comprises a plurality of wires, and at least one end of the plurality of wires is electrically connected to the light source substrate.

5. The illumination device according to claim 2, wherein the electrical connection elements are conductive terminals, each of the electrical connection elements has a receiving channel and a contact arm extending into the receiving channel, and one end of a connection line is inserted into the receiving channel and is in contact with the contact arm.

6. The illumination device according to claim 3, wherein each of the electrical connection elements is a connector, and one end of each of the connection lines is provided with a docking connector, and the connector cooperates with the docking connector in a plug-in manner.

7. The illumination device according to claim 6, wherein the connector comprises a first insulating body and first terminals mounted within the first insulating body, and the docking connector comprises a second insulating body and second terminals mounted within the second insulating body, an amount of the first terminals, an amount of the second terminals and an amount of wires in each of the connection lines are the same.

8. The illumination device according to claim 1, wherein the base is provided with a first through hole penetrating an upper surface and a lower surface of the base, a recessed groove for accommodating the light source substrate, and a positioning convex rib located in the recessed groove, and the light source substrate is provided with a positioning hole that cooperates with the positioning convex rib.

9. The illumination device according to claim 8, wherein the base is further provided with a snap-fit portion that is snap-connected to the light distribution element, and the light distribution element is provided with a second through hole corresponding to the first through hole.

10. The illumination device according to claim 9, wherein the second through hole is a stepped hole.

11. The illumination device according to claim 8, wherein the plurality of light sources are arranged in a circumferential direction, and the positioning hole is located inside the plurality of light sources.

12. The illumination device according to claim 1, wherein the light distribution element is provided with a light distribution portion corresponding to the plurality of light sources, a lower surface of the light distribution portion is provided with a recessed groove which is in an annular shape, the plurality of light sources correspond to the recessed groove, and shapes of respective cross sections of the light distribution portion in an extending direction are uniform.

13. The illumination device according to claim 12, wherein the recessed groove has a bottom surface which is in a triangular shape, the bottom surface is a light incident surface, and an upper surface of the light distribution portion is a light exit surface.

14. The illumination device according to claim 12, wherein a bottom surface of the light distribution element is further provided with a receiving groove for accommodating the electrical connection elements and an opening that is communicated with the receiving groove and enables one end of a connection line to extend into the opening.

15. The illumination device according to claim 1, wherein the illumination device further comprises a driving power source electrically connected to the connection lines, and the driving power source is provided inside the housing or outside the housing.

16. The illumination device according to claim 9, wherein the housing is provided with a plurality of hollow positioning posts that cooperate with the light source modules, and the hollow positioning posts are accommodated in the first through hole and the second through hole.

17. The illumination device according to claim 16, wherein the illumination device further comprises screws that cooperate with the hollow positioning posts, and the screws fix the light source modules to the housing.

18. The illumination device according to claim 17, wherein the housing comprises a bottom wall and a side wall extending upward from an edge of the bottom wall, and the plurality of hollow positioning posts are disposed on the bottom wall.

19. The illumination device according to claim 1, wherein the base is provided with a snap-fit portion that is snap-connected to the housing.

20. The illumination device according to claim 1, wherein the illumination device further comprises a fixing member fixed in the housing, and the base is provided with a snap-fit portion that is snap-connected to the fixing member.

21. A method of manufacturing an illumination device, comprising: providing a housing, positioning a plurality of light source modules in the housing, and connecting a plurality of connection lines electrically with the plurality of light source modules, and wherein each of the light source modules comprises: a base, a light source substrate provided on the base, a plurality of light sources provided on the light source substrate, electrical connection elements provided on the light source substrate, and a light distribution element connected with the base and/or the light source substrate, and wherein the light source substrate and the electrical connection elements are between the light distribution element and the base, and the connection lines and the electrical connection elements are electrically connected.

* * * * *